US007134440B1

(12) United States Patent
Dombeck

(10) Patent No.: US 7,134,440 B1
(45) Date of Patent: Nov. 14, 2006

(54) SELF-ADHESIVE FRENCH MANICURE TIP GUIDE APPLICATION DEVICE

(76) Inventor: Danice Dombeck, 207 - 10th Street Cir., Prairie du Sac, WI (US) 53578

( * ) Notice: Subject to any disclaimer, the term of this patent is extended or adjusted under 35 U.S.C. 154(b) by 40 days.

(21) Appl. No.: 10/961,915

(22) Filed: Oct. 8, 2004

(51) Int. Cl.
*A45D 29/00* (2006.01)

(52) U.S. Cl. ..... 132/285

(58) Field of Classification Search ..... 132/285, 132/319; 434/87; 249/104; 101/127, 128, 101/128.1, 128.21; 211/13.1, 70.6; 248/205.3; 206/471, 477, 481, 479
See application file for complete search history.

(56) References Cited

U.S. PATENT DOCUMENTS 2,234,657 A * 3/1941 Smaldone ..... 132/285
2,709,443 A * 5/1955 Brite ..... 132/285
3,461,885 A * 8/1969 Coveney ..... 132/285
3,946,877 A * 3/1976 Galicia ..... 211/65
5,782,248 A * 7/1998 Chang ..... 132/200
5,908,035 A * 6/1999 Carroll et al. ..... 132/73
5,988,178 A * 11/1999 Bair ..... 132/73

* cited by examiner

*Primary Examiner*—Todd E. Manahan
*Assistant Examiner*—Rachel Running
(74) *Attorney, Agent, or Firm*—Joseph T. Leone, Esq.; DeWitt Ross & Stevens S.C.

(57) ABSTRACT

The present invention provides a self-adhesive tip guide application device for applying tip guides during a French manicure. The present invention allows the user to use both hands in applying the guides to a nail. The device includes an elongated frame having a series of arms extending substantially perpendicularly away from the frame. Each arm contains at least one releasably secured arch-shaped tip guide. The frame also contains a releasably-secured release liner. When removed, the frame can be secured to any surface, thereby more easily allowing the user to apply the guides to the nail.

7 Claims, 1 Drawing Sheet

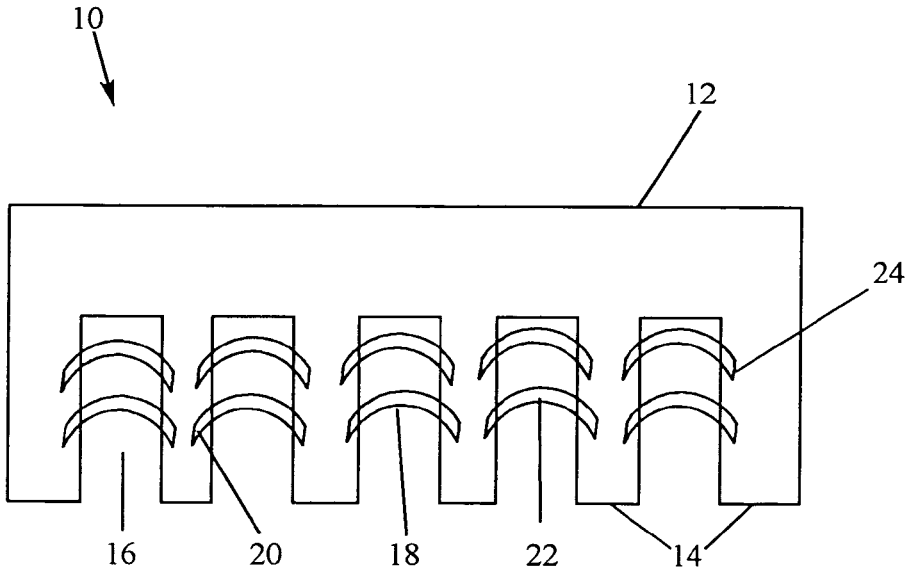
10
12
24
16
20
18
22
14

SELF-ADHESIVE FRENCH MANICURE TIP GUIDE APPLICATION DEVICE

FIELD OF THE INVENTION

The present invention relates to French manicure tip guides and more particularly pertains to an apparatus for applying tip guides for use during a French manicure.

DESCRIPTION OF THE PRIOR ART

French manicures are a well known beauty technique. In a French manicure, a white coat of nail polish is applied along the very tip of the nail, imitating the natural look of the nail. Applying this white coat of polish requires a very steady hand to achieve the desired result. To help apply this coat, tip guides are often used.

Tip guides are well known in the prior art. Individual tip guides are applied to each nail before the nail polish is applied. Conventional tip guides are packaged as a sheet of tip guides. The guides can be adhesively attached to a release liner or may be loosely stacked together. In use, each guide must be individually removed from its packaging and secured to the nail. Correctly applying these delicate tip guides is often difficult, frustrating, and very time-consuming, especially for users who are not ambidextrous.

The hardest part of applying conventional tip guides is keeping the guide in the proper form. The arch-shaped form of conventional tip guides is prone to folding on itself, or otherwise distorting from the desired shape during application. This results in inaccurate application of the guide and does not achieve the desired look in the finished manicure. Further, some forms of tip guides require the guide to be placed on the nail and then secured in place with a layer of polish. Other tip guides are applied by hand and secured in place using adhesive. Regardless, applying conventional tip guides is very time-consuming and often results in individual guides being destroyed due to accidental tearing or misapplication. The common disadvantage of all conventional tip guides is the difficult application to each nail.

Therefore, it can be appreciated that there exists a continuing need for a new and improved apparatus for quickly and easily applying tip guides for use in a French manicure without distorting the shape of the guide. In this regard, the present invention substantially fulfills these needs.

SUMMARY OF THE INVENTION

In view of the foregoing disadvantages inherent in the known types of tip guides, the present invention provides an improved apparatus for the quick and easy application of tip guides for use in a French manicure. As such, the general purpose of the present invention, which is described subsequently in greater detail, is to provide a new and improved apparatus for the application of tip guides which has none of the disadvantages of the prior art tip guides.

A self-adhesive tip guide application device is provided. The device comprises an elongated frame having a front surface, an adhesive rear surface, and several adjacent arms. The arms extend substantially perpendicularly away from the frame and define a series of open slots. Preferably, the arms are spaced equidistantly along the length of the frame.

The device also includes a series of individual tip guides. Each guide is in the form of an arch-shaped sticker. Each guide has a first end, a middle portion, an opposing second end and an adhesive rear surface. The first end of each guide is preferably releasably attached to an arm of the frame and the second end of the guide is releasably attached to an adjacent arm of the frame. In a preferred embodiment of the present invention, the ends of at least two guides are on each arm, with some arms having at least four ends on each arm. The middle portion of the guide remains unattached to the frame of the device.

The device also comprises a release liner releasably adhered to at least a portion of the adhesive rear surface of the frame. The release liner can adhere to the entire frame, including the arms and guides, or the release liner can only adhere to the frame itself and not to the arms or guides.

The device of the present invention has many advantages. For instance, the adhesive rear surface of the frame allows the rear portion of the device to be secured to the edge of a surface, such as a table top, with the arms and their corresponding guides extending out from the edge. This frees both hands of the user to apply the arch-shaped tip guides to the nail. The tip guides are already in the proper position for application to the nail and can be applied directly to the nail with a minimum of effort. In use, the adhesive rear surface of the tip guide can be positioned against the nail while the guide is still attached to the frame. In this manner, the user can insure the guide is in the correct position before completely applying the guide to the nail and removing the guide from the frame. Further, the device of the present invention allows users to apply the arch-shaped tip guides without wasting the guides through poor application. In this manner, a quick and easy-to-use tip guide application device is provided.

The objects and advantages of the invention will appear more fully from the following detailed description of the preferred embodiment of the invention made in conjunction with the accompanying drawings.

BRIEF DESCRIPTION OF THE FIGURES

The sole drawing FIGURE is a top view of the self-adhesive tip guide application device of the present invention showing the frame, the elongated arms, and the arch-shaped tip guides.

DETAILED DESCRIPTION OF THE INVENTION

Referring now to the FIGURE, the present invention provides a self-adhesive tip guide application device 10. The device 10 comprises an elongated frame 12 having at least one but preferably as many as six arms 14 extending substantially perpendicularly away from the frame 12. In the preferred embodiment six arms 14 are shown, but other configurations may be used. The arms 14 define a series of open slots 16.

The frame 12 also comprises an adhesive rear surface (not shown). The frame 12 of the present invention can be made of cardboard or any lightweight yet rigid material including but not limited to plastic and the like.

The device 10 further comprises a series of arch-shaped tip guides 18. Each tip guide 18 has a first end 20, an arched middle portion 22, an opposing second end 24 and an adhesive rear surface (not shown). In a preferred embodiment, the guides 18 have releasably-attached release liners (not shown) protecting the adhesive rear surface until the guides 18 are ready for application. However, in alternate embodiments, the guides 18 do not have individual release liners.

In a preferred form of use, the first end 20 of a guide 18 is releasably attached to an arm 14 of the frame 12. The second arm 20 of the same guide 18 is then releasably attached to an adjacent arm 14 of the frame 12. In this manner, the guides 18 are releasably attached to the frame 12 of the device 10.

In a preferred embodiment of the device 10, guides 18 are releasably secured to the arms 14 of the frame 12 such that preferably ten guides 18 are releasably secured to the frame 12. In this embodiment, a user can complete a single manicure by applying the guides 18 to ten fingernails. A user may also complete a single pedicure by applying the guides 18 to ten toenails. In this manner, the device 10 contains the necessary amount of guides for a single manicure or pedicure. In alternate embodiments, as many as twenty guides 18 may be secured to the frame 12. This embodiment allows a user to complete two manicures or a single manicure and pedicure using one device 10, thereby providing a quick and efficient device for use during a manicure.

Regardless of number, the tip guides 18 are attached to the arms 14 of the device 10 in such a manner that the ends 20 and 24 of the guide 18 are secured but the middle portion 22 of the guide 18 remains unattached. As seen in FIG. 1, the middle portion 22 of the guide 18 crosses the open slots 16 defined by the arms 14. This allows a user to position the guides 18 on the nail without removing the guide 18 from the device 10, thereby increasing the ease and efficiency of application.

The device 10 also includes a releasably-attached release liner (not shown). The liner contacts at least a portion of the adhesive rear surface of the frame 12. In the preferred embodiment, the liner contacts only the frame 12 and does not contact the arms 14 or the guides 18. In this embodiment, each guide 18 has an individual release liner (not shown) protecting the adhesive rear surface of the guide 18 until application during a manicure. The advantages of this embodiment are that the guides 18 remain protected until the user is ready to apply them, thereby eliminating any accidental waste of a guide 18.

However, in an alternative embodiment, the release liner may cover the rear surface of the entire device 10, including the frame 12, arms 14 and guides 18. In this embodiment, when the release liner is removed from the rear of the device 10, the adhesive rear surface of the frame 12 and the guides 18 is exposed, leaving the guides 18 ready to be applied directly to the user's nails. The advantages of this embodiment are that the guides 18 are immediately ready for application, thereby eliminating the time-consuming step of removing individual release liners.

In use, the release liner attached to at least a portion of the adhesive rear surface of the frame 12 is removed, and the frame 12 is secured to a surface. Any surface will suffice, but in a preferred embodiment, the frame 12 is secured to a surface such that a user can easily apply the arch-shaped guides 18 to a nail. The adhesive rear surface of the frame 12 allows the user to use both hands to position the guides 18 on the nail without using one hand to hold the device 10. In this manner, a much more efficient and easy-to-use tip guide application device is provided for the application of tip guides during a French manicure.

The device 10 of the present invention may be used to apply tip guides to any nail for any sort of manicure. The invention is not limited to the use during French manicures, but may be used for French pedicures, regular manicures and more.

It is understood that the invention is not confined to the particular construction and arrangement of parts herein illustrated and described, but embraces such modified forms thereof as come within the scope of the following claims.

What is claimed is:

1. A device comprising:

a) an elongated frame having a front surface, an adhesive rear surface, and several adjacent arms extending away from the frame, the arms defining a series of open slots;

b) a series of arch-shaped guides, each guide having a first end, an opposing second end, and an adhesive rear surface, wherein the first end of each guide is releasably attached to an arm of the frame, and the second end is attached to an adjacent arm of the frame; and c) a release liner releasably adhered to at least a portion of the adhesive rear surface of the frame.

2. The device of claim 1, wherein the arms are spaced equidistantly along the frame.

3. The device of claim 1, wherein the arms extend substantially perpendicularly from the frame.

4. The device of claim 1, wherein the release liner adheres to the frame, arms and guides.

5. The device of claim 1, wherein the release liner does not adhere to the arms or guides.

6. The device of claim 1, wherein the frame is made of cardboard.

7. The device of claim 1, wherein the ends of at least two guides are on each arm.

* * * * *